US005164551A

United States Patent [19]

Harwood et al.

[11] Patent Number: 5,164,551

[45] Date of Patent: Nov. 17, 1992

[54] STAMP FORMED MUFFLER WITH COMPOUND REINFORCEMENT PATTERN FOR PREVENTING SHELL RING

[75] Inventors: Jon W. Harwood; Michael W. Clegg, both of Toledo, Ohio

[73] Assignee: AP Parts Manufacturing Co., Ohio

[21] Appl. No.: 624,888

[22] Filed: Dec. 3, 1990

[51] Int. Cl.[5] ..... F01N 7/00; F01N 7/18

[52] U.S. Cl. ..... 181/238; 181/272; 181/273; 181/282

[58] Field of Search ..... 181/204, 212, 238, 240, 181/230, 228, 243, 250, 272, 282, 232, 265, 268, 273

[56] References Cited

U.S. PATENT DOCUMENTS 4,958,701 9/1990 Moring, III ..... 181/282

5,004,069 4/1991 Van Blaircum et al. ..... 181/282

*Primary Examiner*—Michael L. Gellner

*Assistant Examiner*—Khanh Dang

*Attorney, Agent, or Firm*—Anthony J. Casella; Gerald E. Hespos

[57] ABSTRACT

A reinforced stamped muffler is provided. The muffler includes a pair of internal plates secured in face-to-face relationship and formed to define an array of tubes and chambers therebetween. The chambers are provided with at least one array of reinforcing grooves. Larger chambers defined by the internal plates may include a first array of parallel reinforcing grooves and a second array of parallel reinforcing grooves extending transverse to and intersecting the end-most grooves in the first array. All of the grooves preferably extend into intersection with planar portions of the internal plates. The muffler further includes external shells formed to define larger chambers. The larger chambers of the external shells are formed with a major pattern of reinforcing undulations and a minor pattern of undulations or grooves superimposed thereon. The minor pattern preferably includes a parallel array of grooves with end most grooves in the parallel array being intersected by orthogonally extending grooves. All of the grooves in the external shell preferably extend into intersection with a planar peripheral flange.

17 Claims, 2 Drawing Sheets

STAMP FORMED MUFFLER WITH COMPOUND REINFORCEMENT PATTERN FOR PREVENTING SHELL RING

BACKGROUND OF THE INVENTION

Automotive exhaust mufflers function to attenuate the noise associated with the flow of exhaust gas from the engine. In the typical design process, automotive engineers will assess the flow characteristics of the exhaust gas and the space available on the vehicle for the muffler. The engineers then will use known algorithms to develop an appropriate pattern of tubes and chambers within the muffler for attenuating the noise of the exhaust gas. However, the pressure of the flowing exhaust gas can cause vibrations in the walls of the muffler. These vibrations can cause a "shell ring"noise independent of the noise associated with the flowing of the exhaust gas. Thus the muffler often must be designed to dampen the "shell ring".

The typical prior art muffler employs a plurality of tubes supported in a parallel array by a plurality of transversely extending, identically configured oval or circular baffles. The tubes and baffles are then disposed within a generally tubular outer shell of circular or oval cross-sectional configuration conforming to the shape of the baffles. To prevent the outer shell from vibrating excessively and generating a "shell ring"the typical prior art muffler further includes an outer wrapper which is wrapped around the tubular outer shell. The outer wrapper tends to dampen the vibrations of the shell and thereby avoid the above described shell ring. The prior art muffler then is completed by affixing end caps or headers to the opposed longitudinal ends of the muffler.

The prior art further includes mufflers formed partly or entirely from stamped components. For example, an array of tubes may be disposed within an outer shell defined by a pair of opposed stamp formed sheets of metal. The sheets of metal in these prior art mufflers may be stamped to include a generally planar peripheral flange with one or more chambers formed to extend out of the plane defined by the peripheral flange. The opposed external shells of these prior art mufflers are assembled around the array of tubes such that the tubes are disposed within the chambers defined by the external shells. Some such prior art mufflers employ separate conventional tubes disposed within the stamped external shell. However, other prior art mufflers employ tubes which also are defined by stamped components. In particular, a pair of internal plates may be stamped to define channels therein. The channels are disposed to define an array of tubes when the internal plates are secured in face-to-face relationship with one another. The stamp formed internal plates may then be disposed between the above described stamp formed external shells to define the muffler.

Mufflers employing stamp formed external shells are subject to the same potential for shell ring as the above described prior art mufflers with tubular outer shells. Various attempts have been made to eliminate or minimize the shell ring in stamped mufflers by forming arrays of grooves or ridges in the external shells. U.S. Pat. No. 2,484,827 issued to Harley on Oct. 18, 1949 and shows a muffler with deep corrugations formed in each of two opposed casing members. More particularly, each casing includes a peripheral flange with corrugations disposed intermediate the associated peripheral flange. The bottom of each corrugation is disposed to lie within the plane of the peripheral flange, with the top of the corrugations extending out of the plane of the peripheral flange. The corrugations of one casing are disposed to be angularly aligned to the corrugations of the opposed casing. The casings of the muffler shown in U.S. Pat. No. 2,484,827 are mounted together such that the peripheral flanges are in abutting contact with one another and such that the bases of the respective ridges of one casing substantially contact the bases of the ridges in the opposed casing at the points of intersection. The corrugations are provided to define a complex chamber construction through which exhaust gas may flow and not to dampen shell ring. This construction would necessarily require very complex draws in the metal of the casings and would substantially preclude the use of tubes and chambers in the muffler to attenuate a specified pattern of exhaust gas noise.

Another prior art muffler with grooves in an external shell is shown in U.S. Pat. No. 3,176,791 which issued to Betts et al. on Apr. 6, 1965. One external shell of the muffler shown in U.S. Pat. No. 3,176,791 includes an array of very deep parallel grooves, the bottoms of which lie almost in the plane of the peripheral flanges. The opposed external shell is provided with shallower grooves which are generally circular in cross-section and which extend from a first location spaced from the peripheral flange to an opposed location on the muffler also spaced from the peripheral flange. Although reinforcements of this type may reduce vibrations within the walls of a chamber somewhat, it has been found that the entire chamber may vibrate relative to the substantially more rigid peripheral flange. Thus, mufflers with reinforcing grooves or ridges that begin and/or terminate at locations spaced from a peripheral flange have been found to be only marginally effective in reducing shell ring.

The Assignee of the subject invention has made several very significant improvements in stamped mufflers. One of these improvements is shown in U.S. Pat. No. 4,924,968 which is directed to a reinforced outer shell for a stamp formed muffler. In particular, the shell of the muffler shown in U.S. Pat. No. 4,924,968 includes a generally parallel array of reinforcing grooves. Each reinforcing groove intersects the peripheral flange of the external shell at two opposed locations thereon. The extension of each reinforcing groove the entire distance to the associate peripheral flange helps to both reinforce the walls of the external shell while further ensuring a rigid interface of the entire external shell relative to the peripheral flange. The disclosure of U.S. Pat. No. 4,924,968 is incorporated herein by reference.

A further improvement in stamped muffler technology is shown in copending U.S. patent application Ser. No. 577,495 for "STAMP FORMED MUFFLER WITH LOW BACK PRESSURE" which was filed by Michael W. Clegg et al. on Sep. 4, 1990 and which is assigned to the Assignee of the subject invention. Certain embodiments of the muffler shown and described in pending application Ser. No. 577,495 include an external shell defining a single large chamber. Certain embodiments further show and describe mufflers with internal plates defining fairly large in-line expansion chambers or cans. It has been found that in many of these embodiments the forces exerted by the exhaust gas flowing through the muffler will create vibrations and/or dimensional changes in the internally disposed in-line expansion chambers of the muffler. Vibrations of an internal chamber may cause shell ring similar to that described above with respect to chambers defined by the external shell. Furthermore, dimensional changes of the internally disposed in-line expansion chambers can alter the acoustical performance of the chamber. Vibration and dimensional changes of internal chambers can be avoided by employing a thicker gauge metal. However, the use of thicker metal imposes substantial cost and weight penalties on the muffler. Conversely, there can be substantial cost and weight advantages to be attained by employing lighter gauge metal.

As noted above, the external shell of the muffler shown in copending application Ser. No. 577,495 defines a single large chamber. Mufflers of this design offer several manufacturing advantages in that the deep draws required for plural chamber shells can be avoided, thereby utilizing less metal for the muffler. However, larger chambers may be more prone to shell ring, and in many instances, the prior art patterns of grooves depicted in the above described U.S. Pat. No. 4,924,968 are not sufficiently successful in attenuating noise.

In view of the above, it is an object of the subject invention to provide a stamp formed muffler with chambers that are highly resistant to vibration and associated shell ring.

It is another object of the subject invention to provide a stamp formed muffler with chambers that are dimensionally stable when subjected to forces imposed by flowing exhaust gas.

Another object of the subject invention is to provide a stamp formed muffler that can provide superior reinforcement with lighter gauge metal.

A further object of the subject invention is to provide a stamp formed muffler with internally and externally disposed chamber wall reinforcements.

SUMMARY OF THE INVENTION

The subject invention is directed to a muffler comprising at least one chamber that is formed by stamping or by other known material formation processes, such as hydroforming or the like. The muffler may further comprise an array of tubes communicating with the formed chamber of the muffler.

The chamber may be formed in an external shell of the muffler with conventional internal components. Alternatively or additionally, the muffler may comprise plates formed to define tubes and at least one chamber. The tubes and chamber formed in the plates of the muffler may communicate with a chamber defined by an external shell as set forth above.

At least one chamber of the muffler is provided with reinforcing means to ensure dimensional stability of the chamber when subjected to the forces of flowing exhaust gas and further to prevent vibration and associated shell ring. The reinforcing means may comprise a minor pattern of undulations, waves, grooves, corrugations, ribs or the like. For simplicity, the reinforcing means of the minor pattern will be referred to generically as grooves. The minor pattern may comprise a first array of parallel grooves and a second array of parallel grooves intersecting the outermost grooves in the first array of parallel grooves and extending angularly therefrom. All of the grooves preferably extend into intersection with portions of the plate or shell adjacent the chamber. The minor pattern of reinforcing means may be superimposed on a major pattern of reinforcing means. The major pattern may define a relatively small number of large amplitude waves extending along the length of the muffler. The major pattern may also define waves or undulations extending from side to side on the muffler. Thus, a complex pattern of relatively large amplitude waves may be formed on a chamber of the muffler with a minor pattern of small amplitude waves, grooves or the like superimposed thereon.

The major pattern of waves or undulations in an external shell of the muffler may be disposed such that low points in the major wave pattern are in register with chambers or tubes defined by internal plates of the muffler. These low points in the external shell may then be securely affixed to the opposed chamber or tubes of the internal plates. The connection between the external shell and the internal plates at these locations further contributes to reinforcement of both the external shell and the internal plates. The attachment may be by mechanical means, by plunge welding or by other known connection processes.

DETAILED DESCRIPTION OF THE PREFERRED EMBODIMENTS

Figure 1:
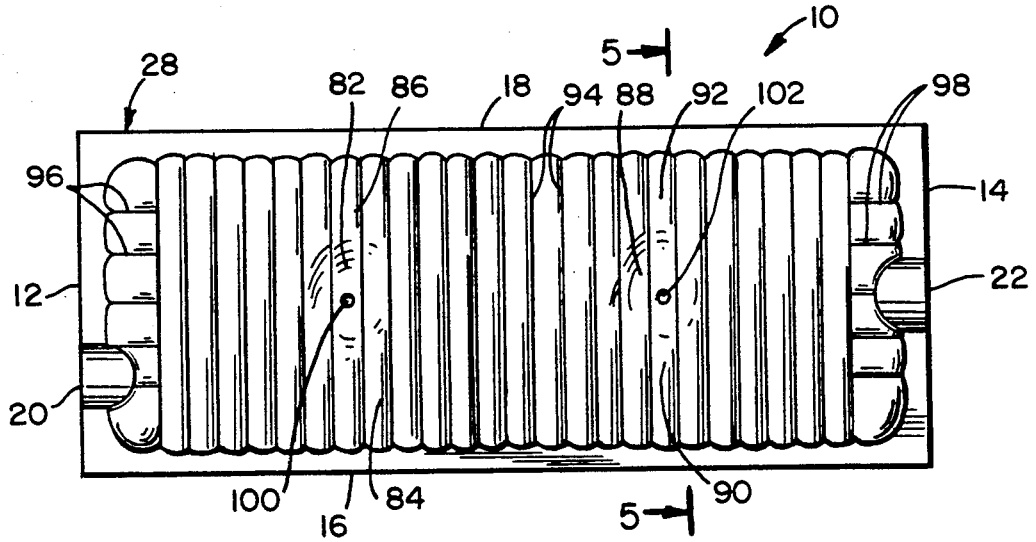
FIG. 1 is a top plan view of a muffler in accordance with the subject invention.

A muffler in accordance with the subject invention is identified generally by the numeral 10 in FIGS. 1-5. The muffler 10 is of generally rectangular plan view configuration, with opposed first and second longitudinal ends 12 and 14 and opposed first and second sides 16 and 18. An inlet 20 extends into the muffler 10 at the first end 12 thereof, while an outlet 22 extends from the muffler 10 at the second end 14. The inlet and outlet 20 and 22 will be connected respectively to the exhaust pipe and tail pipe of an exhaust system. Although the muffler 10 is depicted a being rectangular, it is to be understood that various non-rectangular configurations may be provided in accordance with the shape of the available space envelope on the vehicle. Furthermore, the inlet 20 and outlet 22 may be disposed at locations other than the opposed ends 12 and 14 of the muffler 10, and preferred locations will be selected in accordance with the most practical routing for the exhaust pipe and tail pipe on the vehicle.

Figure 3:
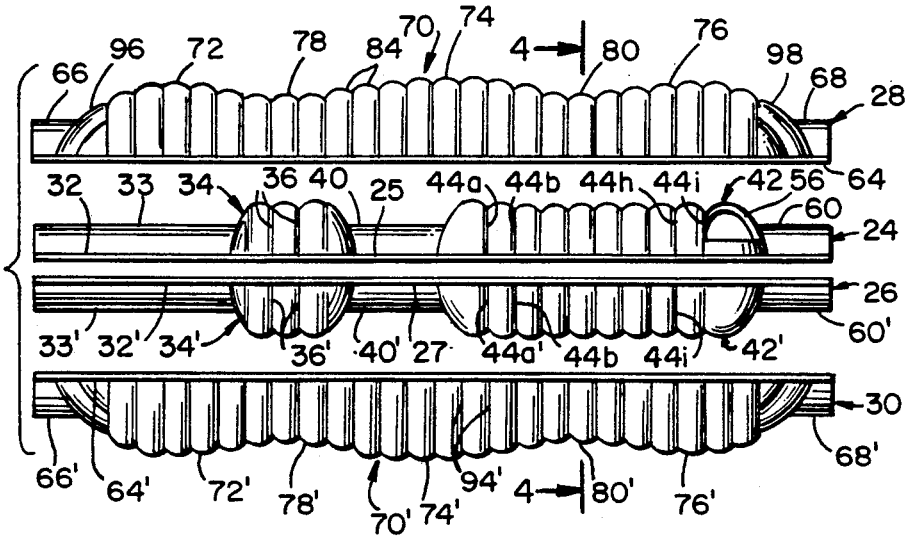
FIG. 3 is an exploded side elevational view of the muffler shown in FIG. 1.
Figure 4:
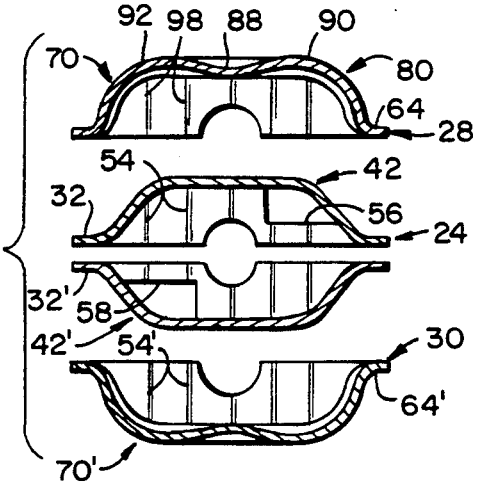
FIG. 4 is a cross-sectional view taken along lines 4—4 in FIG. 3.

As shown most clearly in FIGS. 3 and 4, the muffler 10 is formed from opposed first and second internal plates 24 and 26 respectively and opposed first and second external shells 28 and 30 respectively. The internal plates 24 and 26 and the external shells 28 and 30 are depicted, for simplicity of explanation, as being substantially mirror images of one another. It is to be understood, however, that such symmetry is not required. To further simplify this explanation, parts on the internal plate 26 and on the external shell 30 will be identified by primed numerals which correspond to the unprimed numerals employed on the internal plate 24 and the external shell 28.

Figure 2:
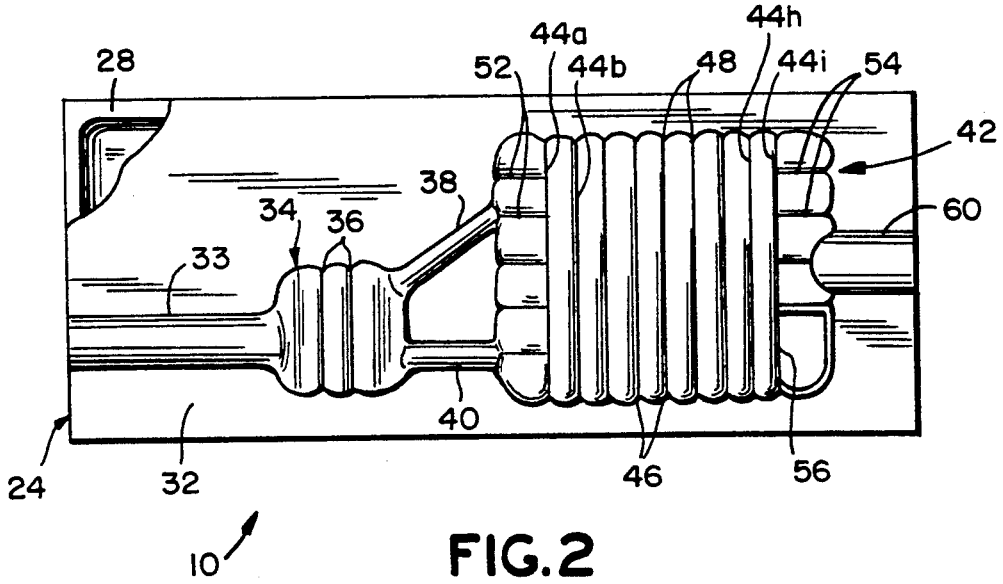
FIG. 2 is a top plan view, partly in section, of the muffler shown in FIG. 1.

The internal plate 24 comprises substantially planar portions 32, as shown in FIG. 2 from which an array of tubes and chambers are formed. More particularly, the internal plate 24 is formed to define an array of channels and cavities disposed to define an array of tubes and chambers when the planar portions 32 and 32' of the plates 24 and 26 respectively are secured in abutting face-to-face relationship with one another.

With reference to FIG. 2, the internal plate 24 is formed to define an inlet tube 33 extending from the inlet 20 of the muffler 10 to an upstream in-line expansion chamber 34. It will be noted that the upstream in-line expansion chamber 34 is relatively small, but is characterized by parallel groove 36 extending entirely thereacross and intersecting the planar portions 32 of the internal plate 24. In view of the relatively small size of the chamber 34, the simple pattern of parallel reinforcing grooves 36 will be adequate for preventing vibration related noise and for ensuring a sufficient degree of dimensional stability in response to the forces imposed by the flowing exhaust gas. As shown in FIG. 3, a comparable array of grooves 36' is formed in the chamber 34' of the internal plate 26.

The internal plate 24 is further formed to define unidirectional flow tubes 38 and 40 which extend from the upstream in-line expansion chamber 34 to a downstream in-line expansion chamber 42 as shown in FIG. 2. It will be noted that the downstream in-line expansion chamber 42 is substantially larger than the chamber 34. To prevent vibration related noise in the chamber 42 and to ensure dimensional stability, portions of the plate 24 defining the chamber 42 are characterized by a first array of parallel reinforcing grooves **44*a*–44*i* extending entirely across the chamber 42 to intersect planar portions 32 of the internal plate 24. The grooves 44*a*–44*i* are aligned to extend substantially parallel to the opposed ends 12 and 14. Each groove 44*a*–44*i* intersects the planar portions 32 of the internal plate 24 at two locations, namely a first location 46 in proximity to the first side edge 16 and a second location 48 in proximity to the second side edge 18. In view of this construction, portions of the chamber 42 adjacent planar portions 32 of the plates 24 and 26 are substantially scalloped as depicted most clearly in FIG. 2. Corresponding parts on the internal plate 26 are identified by similar but primed numerals as shown in FIGS. 3 and 4**.

With further reference to FIG. 2, it will be noted that the chamber 42 is substantially larger than the chamber 34, and is therefore more susceptible to vibration and/or dimensional changes in response to the flow of exhaust gas therethrough. The parallel grooves **44*a*–44*i* provide most of the reinforcement that is needed for vibration resistance and dimensional stability. However, the parallel grooves 44 cannot extend the entire distance to the ends of the chamber 42 in proximity to the opposed ends 12 and 14 of the muffler. As a result, these opposed end areas of the chamber 42 are provided with a second and third array of short parallel grooves 52 and 54 respectively. The grooves 52 in the second array intersect the endmost groove 44*a* in the first array and extend therefrom to the planar portions 32 of the internal plate 24. Similarly the grooves 54 in the third array intersect the endmost groove 44*i* in the first array and extend to intersect planar portions 32 of the plate 24 near the second end 14 of the muffler 10. As illustrated most clearly in FIG. 2, the intersection of the short grooves 52 and 54 with planar portions of the internal plates 24 provides a scalloped configuration at the opposed longitudinal ends of the chamber 42**.

Figure 5:
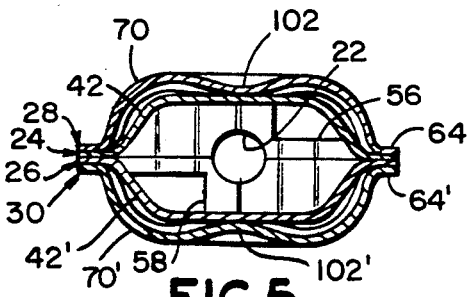
FIG. 5 is a cross-sectional view taken along lines 5—5 in FIG. 1.

The internal plates 24 and 26 are further defined by an aperture 56 extending through the internal plate 24 and an aperture 58 extending through the internal plate 26 as shown in FIG. 5. The apertures 56 and 58 provide communication with the external shells 28 and 30 respectively and cause the chambers defined by the external shells 28 and 30 respectively to function as Helmholtz resonators. The internal plates 24 and 26 are further formed to define an outlet tube 60, 60' extending from the chamber 42, 42' to the outlet 20 of the muffler 10. The flow characteristics and acoustical performance of the arrangement of tubes and chambers defined by the internal plates 24 and 26 is explained in greater detail in copending application Ser. No. 577,495, the disclosure of which is incorporated herein by reference.

The external shell 28 is formed to define a planar peripheral flange 64 disposed to engage planar portions 32 of the adjacent internal plate 24 or 26. The planar peripheral flange 64 is interrupted by an inlet flange 66 and an outlet flange 68 which are dimensioned and disposed to engage the inlet and outlet tubes 33 and 60 respectively defined in the internal plate 24. As before, comparable parts are defined in the external shell 30 and are identified by corresponding primed numerals.

Portions of the external shell 28 inwardly of the peripheral flange 64 are formed to define a single large chamber 70 which, on the embodiment depicted herein functions as a Helmholtz resonator. In other embodiments, communication means other than the aperture 56 and 58 may be provided such that chambers of the external shells function as off-line expansion chambers. As noted above, the provision of the single large chamber 70 provides several functional and manufacturing efficiencies. However, the large size makes the chamber 70 particularly susceptible to vibration and associated shell ring, and to various other dimensional instabilities. To ensure dimensional stability and prevent shell ring, the chamber 70 is provided with a major wave pattern defining peaks 72, 74 and 76 at spaced apart locations along the length of the muffler 10. The major wave pattern further defines a depression 78 between the peaks 72 and 74 and a depression 80 between the peaks 74 and 76. In addition to the end-to-end undulations defined by the major wave pattern, side-to-side undulations further exist. More particularly, the region defined as the depression 78 undergoes a side-to-side undulation such that a low point 82 exists generally centrally between the opposed side edges 16 and 18 respectively of the muffler 10. A first high point 84 is defined between the first side edge 16 and the low point 82. Similarly, a second high point 86 is defined between the second side edge 18 and the low point 82. A similar pattern of side-to-side undulations exists in the depression defined generally by the numeral 80. More particularly, a low point 88 exists in the depression 80 generally centrally between the first and second side edges 16 and 18. A high point 90 exists between the first side edge 16 and the low point 88, while a second high point 92 exists between the second side edge 18 and the low point 88. It is thus seen that the chamber 70 defined in the external shell 28 undergoes a major pattern of end-to-end undulations and a major pattern of side-to-side undulations. As shown in FIGS. 3 and 4, a similar pattern exists in the external shell 30.

Superimposed on the above described and illustrated major pattern of undulations is a minor pattern of undulations defining reinforcement grooves similar to those on the chamber 42 of the internal plate 24. More particularly, an array of parallel reinforcing grooves 94 extends entirely across the external shell 28 from portions of the peripheral flange 64 adjacent the side edge 16 to portions of the peripheral flange 64 adjacent the side edge 18. The grooves 94 of the minor pattern of undulations define smaller amplitudes than the peaks 72, 74 and 76 and the depressions 78 and 80 of the major pattern of undulations. The grooves 94 may be of generally V-shaped cross-section such as those described in detail in U.S. Pat. No. 4,924,968. Furthermore, as in U.S. Pat. No. 4,924,968, each groove 94 extends the entire distance to the peripheral flange 64, such that regions of the peripheral flange 64 adjacent the chamber 70 are substantially scalloped at the points of intersection with the grooves 94.

In addition to the transversely extending grooves 94, the minor pattern of undulations on the external shell 28 further comprises short longitudinally aligned parallel end grooves 96 and 98. The end grooves 96 extend from the transverse groove 94 nearest the first end 12 of the muffler and into intersection with regions of the peripheral flange 64 adjacent the first end 12 of the muffler. In a similar manner, the short longitudinally aligned end grooves 98 extend from the transverse groove 94 nearest the second end 14 of the muffler 10 and into intersection with regions of the peripheral flange 64 nearest the first end 14. With reference to FIGS. 3 and 4 a comparable minor pattern of undulations exists in the external shell 3 and is identified by comparable primed numerals.

The configuration of a major pattern of undulations on which a minor pattern of undulations is superimposed has been found to be particularly effective in attenuating shell ring and minimizing dimensional instability. More particularly, the superposition of transversely extending grooves 94 and short longitudinally aligned grooves 96, 98 onto a major pattern of undulations as depicted by peaks 72–76 and depressions 78 and 80 has proved to be particularly effective on a large chamber, such as the chamber 70 of the external shell 28. The rigidity afforded by the described and illustrated pattern of undulations and grooves can enable the external shell to be manufactured from a lighter gauge of metal without sacrificing overall strength of the muffler. Furthermore, the lighter weight metal can achieve very significant cost advantages and advantages relating to fuel efficiency due to the lighter weight of the exhaust system.

The muffler 10 is assembled as illustrated most clearly in FIGS. 3–5 by first connecting the internal plates 24 and 26 to one another at a plurality of locations on the planar portions 32, 32' thereon. The external shells 28 and 30 are then assembled around the internal plates 24 and 26. The connection of the external shells 28 and 30 to the internal plates 24 and 26 is, at a minimum, carried out entirely around the peripheries thereof. This connection of peripheral portions may be by seam welding, other welding techniques or by mechanical fastening, such as crimping. To further prevent vibration and associated shell ring, the low points 82 and 88 in the depressions 78 and 80 on the chamber 70 preferably are directly securely connected to opposed portions of the internal plate 24 or 26. More particularly, plunge welds 100 and 102 are provided in the low points 82 and 88 to directly connect portions of the chamber 70 to opposed portions of the chambers 34 and 42 respectively. Similar connection of the internal plate 26 to the external shell 30 also is provided.

While the invention has been described with respect to a preferred embodiment, it is apparent that various changes can be made without departing from the scope of the invention as defined by the appended claims. In particular, many different patterns of tubes and chambers may be defined in the internal plates. In some embodiments versions of the internal plates depicted herein may be used with only one external shell or with no external shell at all. In other embodiments the illustrated external shells may be employed with conventional internal components. In still other embodiments a more complex and smaller amplitude major pattern of undulations may be provided on the plates, while a minor pattern of grooves may similarly be employed These and other variations will be apparent to a person skilled in this art after having read the preceding disclosure.

We claim:

1. An exhaust muffler having an array of tubes defining an inlet to the muffler and an outlet therefrom; first and second external shells having peripheral flanges connected to one another and having at least one portion formed to define a chamber extending from the peripheral flanges and disposed in surrounding relationship to the tubes of the muffler, the portion of each said external shell defining the chamber being formed to include major undulations defining a plurality of peaks and at least one depressions between the peaks and minor undulations superimposed on the major undulations, the minor undulations including a plurality of parallel undulations extending entirely across the portion of the respective external shell defining the chamber, whereby superimposition of the minor undulations of the major undulations effectively reinforces the respective external shell and minimizes vibration related noise.

2. A muffler as in claim 4 wherein the minor undulations are substantially parallel to the ends of the muffler, and wherein each said external shell further includes a first array of end undulations extending from the first end of the muffler toward the minor undulations and a second array of end undulations extending from the second end of the muffler toward the minor undulations, the end undulations being substantially parallel to the sides of the muffler.

3. A muffler as in claim 1 wherein each of the minor undulations is of generally V-shaped cross-section.

4. A muffler as in claim 1 of generally rectangular configuration with first and second opposed longitudinal ends and first and second opposed longitudinally extending sides extending between and connecting the ends, the major undulations defining a plurality of peaks at spaced apart locations between the ends of the muffler and at least one depression between the peaks.

5. A muffler as in claim 4 wherein the muffler further comprises a pair of plates secured in face-to-face relationship with one another and disposed intermediate the external shells of the muffler, the plates being formed to define the array of tubes therebetween.

6. A muffler as in claim 5 wherein the depression of each said external shell is securely connected to one of the plates of the muffler.

7. A muffler as in claim 6 wherein a portion of each said plate is formed to define at least one in-line extension chamber communicating with the tubes, the depression of each said external shell being securely connected to the portion of one sad plate formed to define the in-line expansion chamber.

8. A muffler as in claim 7 wherein the portion of each said plate defining the in-line expansion chamber is further provided with an array of reinforcing grooves formed therein to prevent vibration related to noise.

9. A muffler as in claim 4 wherein the major pattern of undulations in each external shell further comprises side-to-side undulations extending from the first side of the muffler to the second side of the muffler, the side-to-side undulations being defined by first and second spaced apart high points disposed in proximity to the respective first and second sides of the muffler and a low point intermediate the high points.

10. A muffler comprising:

first and second internal plates secured in face-to-face relationship and formed to define an array of tubes and at least one chamber therebetween, the tubes comprising an inlet tube and an outlet tube, the chamber defined by the internal plates being characterized by a first array of parallel reinforcing grooves in each said internal plate and at least a second array of parallel reinforcing grooves intersecting at least one of the grooves in the first array of parallel grooves and extending therefrom to a planar portion of the respective internal plate; and first and second external shells each being formed to define a peripheral flange and a chamber extending from the peripheral flange, said first and second external shells being securely connected respectively to the first and second internal plates such that the chamber defined by each said external shell surrounds the tubes and chamber of the respective internal plate, the chamber of each said external shell being characterized by at least one array of reinforcing undulations therein with a plurality of peaks and at least one depression, a portion of the depression defined in the chamber of each said external shell being securely connected to an opposed portion of the respective internal plate.

11. A muffler as in claim 10 wherein the array of reinforcing undulations in each said external shell defines a first pattern of undulations, and wherein the chamber defined by each said external shell is further characterized by a second pattern of undulations superimposed on the first pattern, the undulations of the second pattern defining smaller amplitudes than the undulations of the first pattern.

12. A muffler as in claim 11 wherein the second pattern of undulations comprises a first array of parallel grooves formed in the external shell.

13. A muffler as in claim 12 wherein the second pattern of undulations in the external shell further comprises a second array of parallel grooves extending from one of the grooves in the first array of parallel grooves to the peripheral flange of the muffler.

14. A muffler as in claim 13 wherein the second pattern of undulations in the external shell is further characterized by a third array of parallel grooves extending from another of the parallel grooves in the first array to a second region on the peripheral flange of the muffler.

15. A muffler comprising:

first and second plates comprising planar portions secured in abutting face-to-face relationship with one another and formed portions extending from the planar portions to define an array of tubes between the plates, the tubes communicating with an inlet to the muffler and with an outlet from the muffler;

at least one external shell formed to define a peripheral flange and a chamber extending from the peripheral flange, the peripheral flange of the external shell being attached to planar portions of said first internal plate such that the chamber of the external shell surrounds selected portions of the tubes of the first internal plate, the chamber being formed to define a major pattern of undulations therein comprising at least one pair of spaced apart peaks and at least one depression disposed therebetween, said external shell being further characterized by a minor pattern of undulations superimposed upon the major pattern of undulations therein.

16. A muffler as in claim 15 wherein muffler includes first and second opposed sides, the minor pattern of undulations comprises at least a first plurality of generally parallel grooves, each of said parallel grooves extending from the first side of the muffler to the second side thereof and intersecting the peripheral flange at the first and second opposed sides of the muffler.

17. A muffler as in claim 16 wherein the minor pattern of undulations comprises a second plurality of grooves extending into intersection with one of the grooves in the first plurality of grooves defining the minor pattern of undulations.

* * * * *